US005806787A

United States Patent [19]

Schneider

[11] Patent Number: 5,806,787

[45] Date of Patent: Sep. 15, 1998

[54] FOLDING WIRE REEL STAND

[76] Inventor: Wayne A. Schneider, 4 Dancer Dr., Budd Lake, N.J. 07828

[21] Appl. No.: 923,734

[22] Filed: Sep. 4, 1997

[51] Int. Cl.[6] ..... B65H 49/00

[52] U.S. Cl. ..... 242/598.5; 242/129.5; 242/129.6

[58] Field of Search ..... 242/129, 129.5, 242/129.6, 129.7, 130, 598.5

[56] References Cited

U.S. PATENT DOCUMENTS

| | | | |
|---|---|---|---|
| 2,601,960 | 7/1952 | Hick . | |
| 3,383,071 | 5/1968 | Godson | 242/129.6 |
| 3,920,194 | 11/1975 | Parsen . | |
| 4,030,704 | 6/1977 | Beierle et al. | 242/129.5 |
| 4,391,422 | 7/1983 | McDonald | 242/129.6 |
| 4,611,645 | 9/1986 | Whisnant | 242/129 |
| 4,746,078 | 5/1988 | Setzke . | |
| 4,752,047 | 6/1988 | Franks, Jr. | 242/129.6 |

FOREIGN PATENT DOCUMENTS

| | | | |
|---|---|---|---|
| 2 090 578 A | 7/1982 | United Kingdom | 242/129 |

*Primary Examiner*—John P. Darling
*Attorney, Agent, or Firm*—Joseph W. Molasky & Associates

[57] ABSTRACT

A wire reel stand that is capable of supporting multiple wire reels in its open position and is easily collapsed for storage. The stand includes a pair of "U"-shaped frame supports, with a central wire reel support rod disposed between the open ends of the frame supports. A pair of angle brackets, attached to one of the frame supports, is utilized to maintain the stand in a fixed, open position. Side bars are releasably attached to each frame member and, advantageously, remain attached to the wire reel stand in its closed configuration.

8 Claims, 3 Drawing Sheets

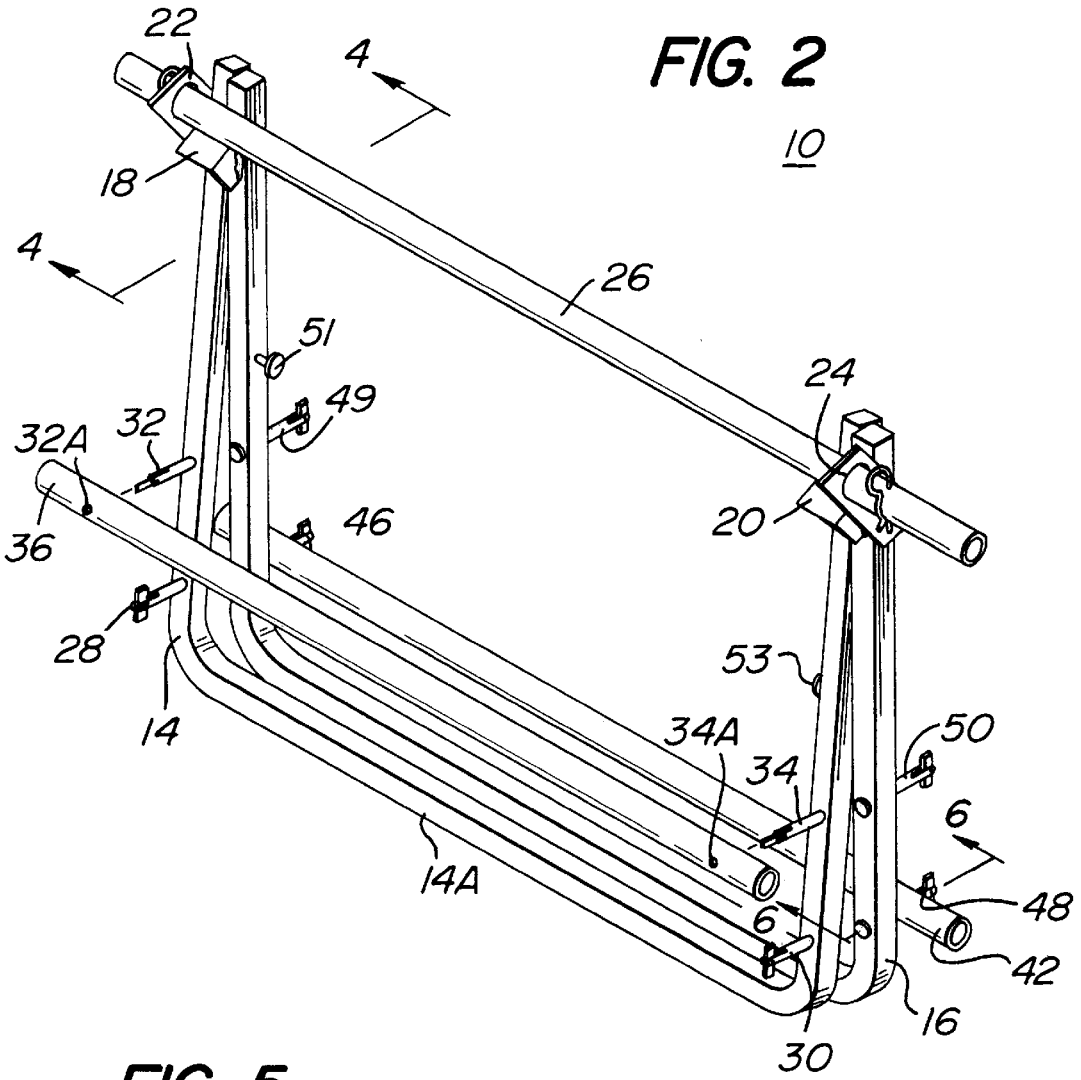
FIG. 2
FIG. 5
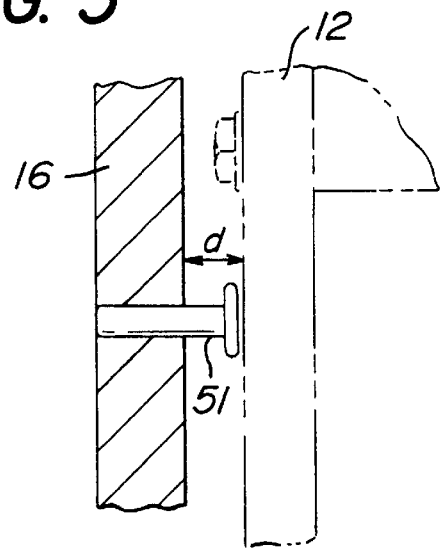
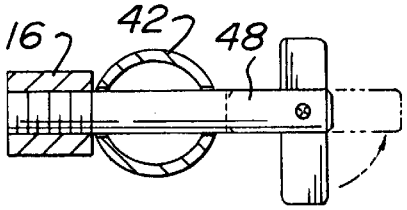
FIG. 6

FIG. 3
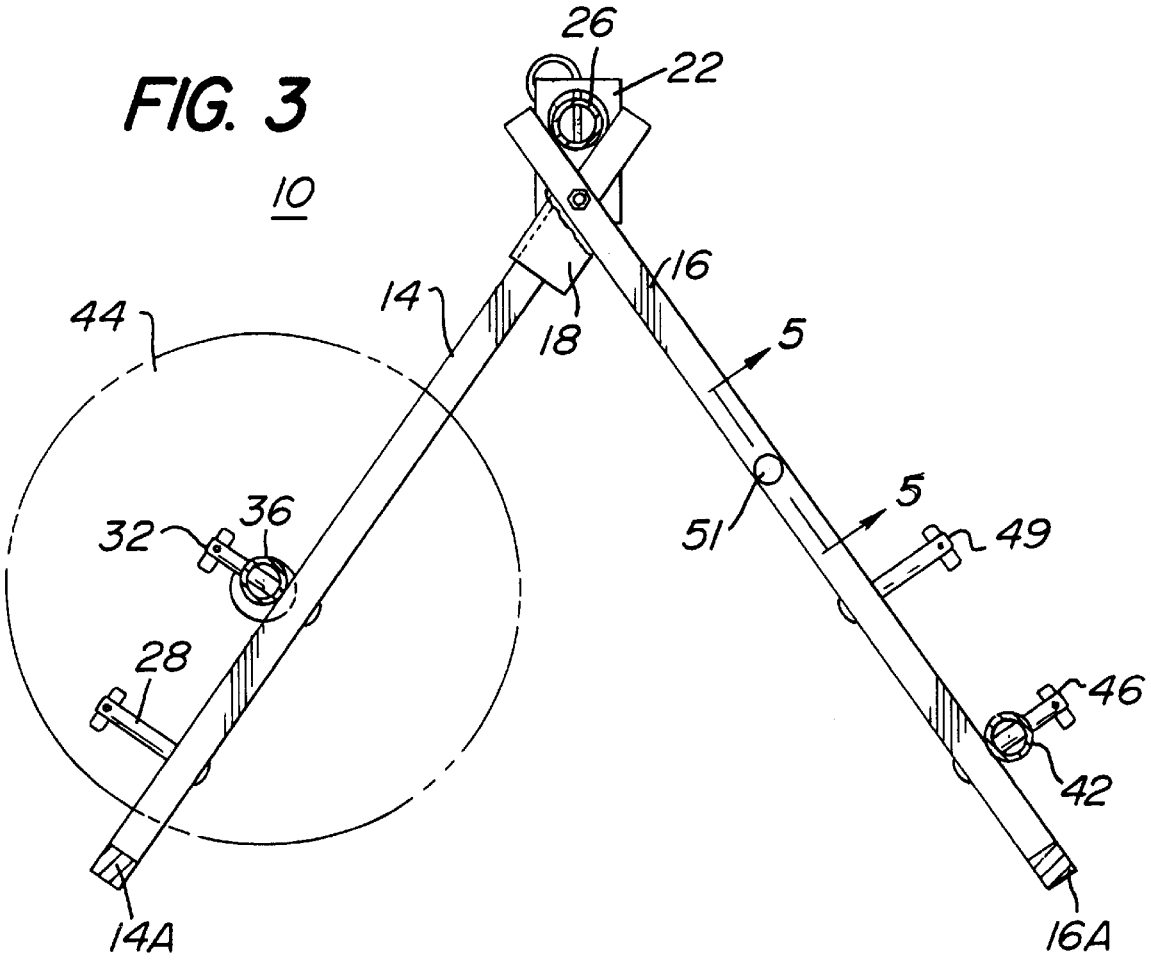
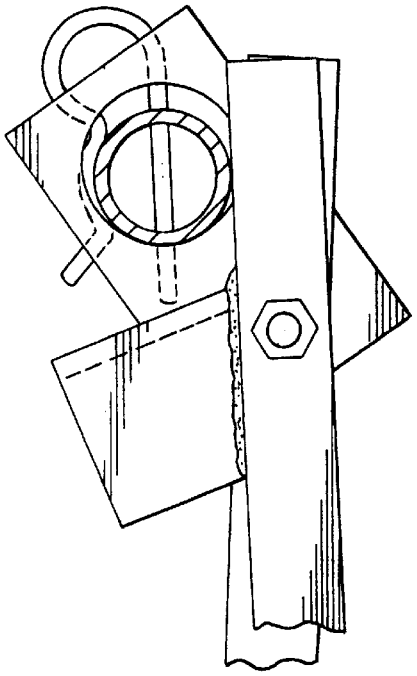
FIG. 4

FOLDING WIRE REEL STAND

BACKGROUND OF THE INVENTION

1. Field of the Invention

The present invention relates to a wire reel stand and, more particularly, to a wire reel stand that may be folded into a compact arrangement for movement and storage.

2. Description of the Prior Art

Wire reel stands are used extensively in the building and trade industries as a relatively easy means for supporting a wire reel while unrolling the extensive lengths of wire that need to be run throughout a construction site. There exist in the art various types of reel supports that are used to facilitate the unwinding of the wire from the reel. Examples of such supports may be found in U.S. Pat. No. 2,601,960; 3,383,071; 4,391,422; and 4,746,078. A particular support arrangement that is collapsible when not in use is disclosed in U.S. Pat. 3,920,194, issued to E. M. Parsen on Nov. 18, 1975. The Parsen wire reel support comprises a set of three nested U-frames. When fully separated, the three frames form a "Y" configuration, with two arms used as ground support and the remaining arm used to hold the wire reel. In one particular configuration, each frame can hold a separate reel, such that three reels may be simultaneously loaded onto the support. Although the Parsen support can be described as an improvement over the state of the art, it may be subject to unwanted collapse, since a chain is the only means used to maintain the "open" configuration of the support.

SUMMARY OF THE INVENTION

A wire reel stand is disclosed that is capable of being folded into a compact configuration when not in use. The stand includes a pair of support leg members, of generally a "U" shape, attached at their ends to form an inverted "V" shape when separated. One of the support leg members includes a pair of angle irons attached to its end portions. The angle irons are permanently fixed such that when the pair of leg members are pulled outward into the "open" (i.e., inverted "V") position of the stand, the angle between the legs is fixed, supported and controlled. For example, an angle of approximately 70 degrees has been found to provide sufficient support for the stand structure, while allowing a large-sized reel to be attached to the support. Positioned between the open ends of the support leg members is a cross bar member. In the "open" position, the cross bar is used to support a wire reel. In the "closed" position, the cross bar becomes a convenient carrying handle for the stand. An additional cross bar member ("side bar") is releasably attached to each leg member. The side bar members may be attached to a support leg member at a first, relatively low position when not in use. The side bar member is attached at a second, higher position when used to support an additional wire reel or reels. The symmetry of the stand structure allows for each leg member to support a side bar member. In accordance with the present invention, the cross bar member and side bar members remain attached to the stand when closed, allowing for the complete assembly to be carried and stored as a single unit.

Other and further features of the present invention will become apparent during the course of the following discussion and by reference to the accompanying drawings.

BRIEF DESCRIPTION OF THE DRAWINGS

Referring now to the drawings,

FIG. 2 is an isometric view of the wire reel stand in its "closed" position;

FIG. 3 is a side view of the wire reel stand in its "open" position, illustrated as carrying a wire reel on one of the side bar support members;

FIG. 4 is a cut-away view in perspective of a section of FIG. 2, taken along line 4—4, illustrating in particular the attachment of the cross bar member to the stand using a pair of support members;

FIG. 5 is a view of a portion of one leg support, taken along line 5—5 of FIG. 3, illustrating in particular one of the side guards used to prevent a wire reel from inadvertently coming into contact with the stand; and FIG. 6 is a view of an exemplary side cross bar attachment area, taken along line 6—6 of FIG. 3, illustrating in particular an exemplary releasable attachment configuration suitable for attaching side bars to the stand.

DETAILED DESCRIPTION OF THE PREFERRED EMBODIMENTS

Figure 1:
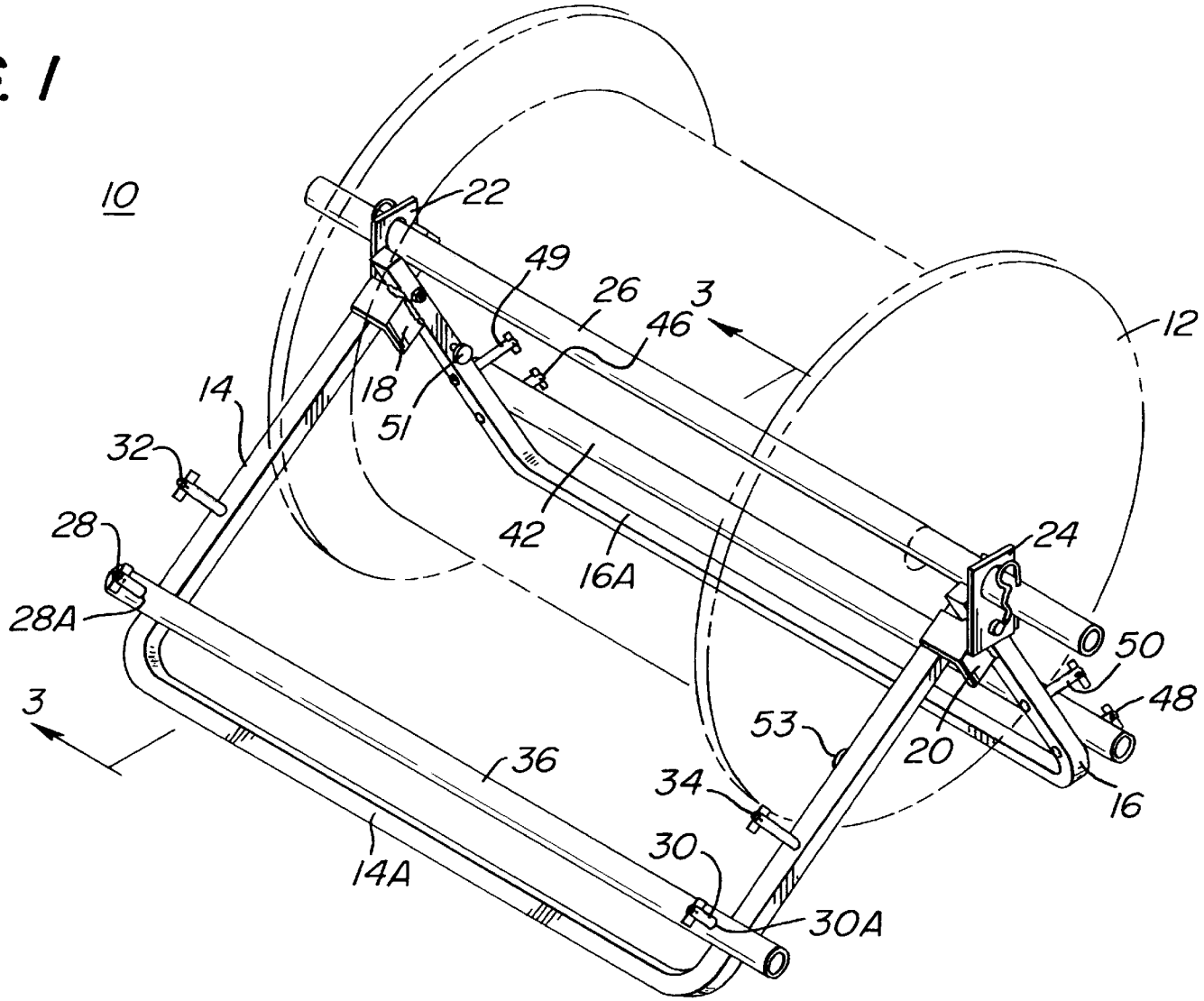
FIG. 1 is an isometric view of the inventive wire reel stand, carrying a single wire reel (illustrated in phantom)

An exemplary wire reel stand 10, in its "open" position, is illustrated in FIG. 1. A conventional reel 12 is illustrated in phantom as being supported by stand 10. Stand 10 includes a pair of U-shaped frame support members 14 and 16. Frame support members 14 and 16 are positioned so that the middle section of each support member (designated 14A and 16A in FIG. 1) rests against the ground and the end legs of each "U" are joined to form (in a side view, such as that of FIG. 3) an inverted "V" structure. A pair of angle irons 18 and 20 are permanently attached to frame support 16 and are positioned to brace against support 14 in the open position. Angle irons 18 and 20 are chosen to provide the desired degree of opening between supports 14 and 16. For example, a 70° angle has been found to provide a sufficient opening for the present purposes. A pair of rod support members 22 and 24 are attached to the terminating ends of rods 14 and 16. Each rod support member includes an aperture so that a cross bar member 26 may be inserted through the apertures and used to support a reel, such as reel 12. Cross bar member 26 may be formed to comprise a length L greater than the width of the reel stand, where the additional length on either end is used as a handle when carrying the reel stand. A releasable attachment mechanism, such as a pair of spring clips, is used to fix bar member 26 between rod support members 22 and 24. Bar 26 may be a pipe or a solid rod, either being considered to provide sufficient support for a wire reel.

For the arrangement as depicted in FIG. 1, only a single reel is being supported. In this configuration, the side bar members are attached at a lower position that does not interfere with the rotation of reel 12 as wire is removed. Rod 14 includes two sets of location pins, a first, lower set 28 and 30, and a second, higher set, 32 and 34. A first side bar 36 is illustrated as releasably attached to lower pins 28,30 by means of a pair of apertures 28*a*,30*a* in bar 36 that fit over pins 28,30. For the particular illustrated embodiment, side bar 26 is releasably attached by using locking pins. One exemplary locking pin is illustrated in detail in FIG. 6. As shown, the pin includes a rotatable end portion that may be held in a first, coaxial position (that is, in line with the body of the pin) when it is desired to place a side bar over the pin. Once the side bar is in place, the end portion of the pin is rotated into a second, perpendicular position (that is, perpendicular to the body of the pin) so that the side bar cannot be inadvertently removed. It is to be understood that various other releasable attachment mechanisms may be used; for example, pins 28,30 could be threaded, and a nut (such as a wing nut) may be used to releasably attach side bar 36 to frame member 14. As long as the attachment is "releasable" such that the bar may be moved between a lower, unused position, and an upper position to serve as a reel-carrying rod, any appropriate attachment means may be used. A side bar member 42 is similarly attached to frame member 16 at a pair of lower pins 46,48, where frame member 16 also includes a pair of pins 49,50 that may be used to locate side bar member 42 at a second, higher position. A pair of side guards 51,53 are attached to frame 16 (or alternatively, may be attached to frame 14) and used to prevent the end faces of reel 12 from coming into contact with frames 14 and 16. The side guards will be described in detail below in association with FIG. 5.

A collapsed configuration of wire reel stand 10 is shown in FIG. 2. As mentioned above, an advantage of the collapsible stand arrangement of the present invention is that all of the pieces remain attached to the stand when closed, allowing for easy storage without losing any of the parts. In the closed position, frame members 14 and 16 are folded together. Rod support members 22 and 24 may be rotated slightly to one side so that cross bar member 26 rests off-center in the folded arrangement. FIG. 4 is an enlargement of this particular portion of the closed configuration, illustrating the location of frame members 14 and 16, as well as rod support member 22 and cross bar member 26. As shown, a spring clip is used to releasably attach rod 26 at support member 22 (a similar spring clip provides attachment of rod 26 at support member 24). Referring back to FIG. 2, side bar members 36 and 42 are attached to frame members 14 and 16, respectively. In the illustration, side bar member 36 is depicted as separated from pins 32 and 34 merely to illustrate the location of the associated apertures 32*a*,34*a* in bar 36 and illustrate the method of attaching side bar member 36 to frame 14. As in the other illustrations, and as clearly illustrated in FIG. 6, a pair of locking pins (i.e., each pin including a rotatable end portion) is used to attach side bar member 36 to frame 14 (as well as side bar 42 to frame 16). For storage purposes, side bar members 36 and 42 may be attached at either the lower position or upper position along the respective frame member.

FIG. 3 is a cut away side view of collapsible wire reel stand 10, configured to support a wire reel 44 (shown in phantom) on side bar 36 of frame support 14. It is to be understood that if the wire reels are relatively short, more than one reel may be supported on a single bar. For the particular arrangement of FIG. 3, side bar 42 remains in its lowered, unused position. However, it is possible for both side bar members to simultaneously support reels, since the separation between frame supports 14 and 16, as controlled by angle irons 18,20 is sufficient to keep the reels on each side of the stand from touching each other.

As mentioned above, reel stand 10 may further include a pair of side guards 51 and 53, fixed to each leg portion of frame 16 (or alternatively, on frame 14). As shown in FIGS. 1 and 5, side guards 51 and 53 are disposed to protrude a predetermined distance into the interior region of stand 10. FIG. 5 contains an enlarged view of side guard 51 and its relationship to spool 12. In general, as the wire is unwound from the spool, the spool will "travel" back and forth between the ends of the stand. The amount of movement will, of course, be a function of the length of the spool as related to the length of the support bar. Side guards 51 and 53 serve to protect the ends of the reel from coming into direct contact with stand 10. Referring to FIG. 5, guard 51 protrudes beyond frame 16 by an amount d sufficient to maintain a space between frame 16 and reel 12.

It is to be understood that although this invention has been described by reference to preferred embodiments, various modifications in shape, size, arrangement of parts and materials may be resorted to without departing from the spirit or scope of the invention and these modifications are meant to be covered by the appended claims.

What is claimed is:

1. A collapsible wire reel stand comprising a pair of "U"-shaped frame members, each member comprising a central horizontal portion and a pair of vertical leg portions, the pair of frame members attached so that the horizontal portions rest on the ground and the opposing leg portions are joined as a hinge capable of being separated to form an opened inverted "V" position and a closed collapsed position;

a pair of angle members attached to one frame member and forming a fixed angle with relation to the remaining frame member in the opened position to control the amount of separation between the frame members when the reel stand is in its opened inverted "V" position;

a pair of rod support members attached to the joined legs of the frame members, each support member including an aperture;

a central rod member for supporting a wire reel, said central rod disposed through the apertures of said pair of rod support members and releasably attached thereto; and at least one side bar member for supporting a wire reel and releasably attached between the vertical leg portions of a frame member, wherein the central rod member and at least one side bar member remain attached to said frame members in the closed, collapsed position.

2. A collapsible wire reel stand as defined in claim 1 wherein the at least one side bar member comprises a pair of side bar members, each side bar member releasably attached to a separate one of the pair of "U"-shaped frame members.

3. A collapsible wire reel stand as defined in claim 1 wherein the pair of "U"-shaped frame members include support pins extending outwardly from the frame members, and the at least one side bar member includes apertures for mating with the support pins to form the releasable attachment.

4. A collapsible wire reel stand as defined in claim 3 wherein each support pin comprises a locking pin including an outer rotatable section, the outer rotatable section having a first position coaxial with the remaining portion of the pin, the first position for allowing an aperture of an associated side bar member to pass over the pin, and a second, perpendicular position, the second position allowing for the side bar member to remain attached to the associated frame member.

5. A collapsible wire reel stand as defined in claim 3 wherein each "U" shaped frame member includes two pair of support pins, a first pair disposed on separate legs of said frame member at a position near the horizontal portion so as to support a side bar member in a first, storage position, and a second pair disposed on separate legs of said frame member at a raised position so as to support a side bar member in a second, wire reel support position.

6. A collapsible wire reel stand as defined in claim 1 wherein the wire reel stand further comprises a pair of side guard members attached to one frame member and disposed so as to be interposed between said frame member and a supported wire reel, said side guard members for preventing said supported wire reel from coming into physical contact with said frame member.

7. A collapsible wire reel stand as defined in claim 1 wherein the central rod member is longer than the pair of "U"-shaped frame members such that the end portions of said rod member extend beyond the rod support members.

8. A collapsible wire reel stand as defined in claim 1 wherein the pair of angle members are configured to provide a fixed angle of substantially 70 degrees between the frame members in the first, opened position.

* * * * *